United States Patent [19]

Bresson et al.

[11] Patent Number: 4,806,234

[45] Date of Patent: Feb. 21, 1989

[54] ORE FLOTATION

[75] Inventors: Clarence R. Bresson; Harold W. Mark, both of Bartlesville, Okla.

[73] Assignee: Phillips Petroleum Company, Bartlesville, Okla.

[21] Appl. No.: 115,392

[22] Filed: Nov. 2, 1987

[51] Int. Cl.[4] ..... B03D 1/02

[52] U.S. Cl. ..... 209/167; 252/61

[58] Field of Search ..... 209/166, 167; 252/61; 558/235, 236, 237; 260/513.5

[56] References Cited

U.S. PATENT DOCUMENTS

| | | | |
|---|---|---|---|
| 2,621,143 | 12/1952 | Goodhue et al. | 167/22 |
| 2,693,485 | 11/1954 | Gobell | 260/500 |
| 2,862,850 | 12/1958 | Goodhue | 167/46 |
| 3,194,825 | 7/1965 | Brotherton | 260/513.5 |
| 3,248,400 | 4/1966 | Fleig | 260/513.5 |
| 3,425,550 | 2/1969 | Baarson | 209/166 |
| 3,464,551 | 9/1969 | Flavey | 209/166 |
| 3,484,488 | 12/1969 | Lichtenwalter et al. | 260/585 |
| 3,940,488 | 2/1976 | Frohberger | 260/513.5 |
| 4,462,898 | 7/1984 | Parlman et al. | 209/166 |
| 4,514,293 | 4/1985 | Bresson et al. | 209/167 |
| 4,554,068 | 11/1985 | Kimble | 209/167 |
| 4,554,108 | 11/1985 | Kimble | 209/167 |
| 4,595,538 | 6/1986 | Kimble et al. | 209/167 |
| 4,601,818 | 7/1986 | Bresson et al. | 209/166 |
| 4,622,131 | 11/1986 | Bresson | 209/167 |
| 4,702,821 | 10/1987 | Bresson | 209/166 |

FOREIGN PATENT DOCUMENTS

| | | | |
|---|---|---|---|
| 496683 | 10/1953 | Canada | 260/513.5 |
| 771182 | 11/1967 | Canada | 209/166 |
| 771181 | 11/1967 | Canada | 209/166 |
| 116045 | 7/1982 | Japan | 260/513.5 |

OTHER PUBLICATIONS

Chemical Abstract No. 78: P124002g.
Chemical Abstract No. 80: P70299e.

*Primary Examiner*—David L. Lacey
*Assistant Examiner*—Thomas M. Lithgow
*Attorney, Agent, or Firm*—Laney, Dougherty, Hessin & Beavers

[57] ABSTRACT

A polyamine substituted dithiocarbamate composition is provided. Also provided are minerals depressant compositions for recovering mineral values from an ore or concentrate wherein the values are recovered in a froth from an aqueous slurry. A process of forming the minerals depressant compositions and an improved ore flotation process using the minerals depressant compositions are also provided.

19 Claims, No Drawings

ORE FLOTATION

BACKGROUND OF THE INVENTION

1. Field of the Invention

In one aspect, the present invention relates to minerals depressant compositions useful in an ore flotation process. In other aspects, the present invention relates to a process of forming the minerals depressant compositions and to an improved ore flotation process using the minerals depressant compositions.

2. Description of the Prior Art

Ore flotation whereby mineral values are recovered in a froth from an aqueous slurry containing the ore or a concentrate of the ore is well-known. In the process, the ore is crushed and an aqueous slurry is formed therefrom. Mineral flotation agents known in the art as "collectors" and mineral flotation depressing agents known in the art as "depressants" are added to the slurry along with other additives such as frothing agents and stabilizers.

Collectors are added to the ore slurry to cause desired minerals contained therein to adhere to bubbles of a froth formed on the surface of the slurry so that they are recovered when the froth is skimmed or otherwise removed from the slurry. Typical mineral flotation collectors include xanthates, amines, alkyl sulfates, arene sulfonates, dithiocarbamates, dithiophosphates, thiols, and fuel oils.

In order to increase the mineral selectivity of ore flotation processes, depressants have been developed and used. That is, the depressants are used to reduce the flotation of undesired metals or ores thereby increasing the production of desired metals or ores.

By the present invention a novel composition is provided. It has been found that the composition is useful as a minerals depressant in an ore flotation process. A process of forming the novel composition and other compositions useful as minerals depressants and a process of using the compositions are also provided.

SUMMARY OF THE INVENTION

In one aspect of the present invention there is provided a polyamine substituted dithiocarbamate composition. It has been found that this composition is useful as a minerals depressant in an ore flotation process. The polyamine substituted dithiocarbamate can be represented by the formula:

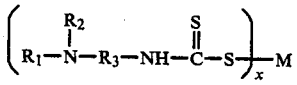

wherein $R_1$ and $R_2$ and of the amine substituent are each selected from the group consisting of an aminoethyl group, an aminohydrocarbyl group and a polyaminohydrocarbyl group $R_3$ of the amine substituent is selected from the group consisting of a hydrocarbyl group, an aminodihydrocarbyl group and a polyaminopolyhydrocarbyl group, is selected from the group consisting of an alkali metal and an alkaline earth metal and x is 1 or 2.

In another aspect of the invention, a process for producing compositions useful as minerals depressants, including the polyamine substituted dithiocarbamate, is provided. In the process, carbon disulfide is reacted with a polyamine in an aqueous solution comprising a compound selected from the group consisting of an alkali metal hydroxide and an alkaline earth metal hydroxide, the polyamine being represented by the formula:

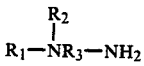

wherein $R_1$ and $R_2$ are each selected from the group consisting of an aminoethyl group, an aminohydrocarbyl group and a polyaminohydrocarbyl group, and $R_3$ is selected from the group consisting of a hydrocarbyl group, an aminodihydrocarbyl group and a polyaminopolyhydrocarbyl group.

In yet another aspect of the present invention, an improved process for the recovery of molybdenum values from an ore containing the same wherein the values are recovered in a froth from an aqueous slurry containing the ore or a concentrate of the ore is provided. In the process, a minerals depressant comprising a composition produced by reacting carbon disulfide with a polyamine in an aqueous alkali metal hydroxide solution or an aqueous alkaline earth metal hydroxide solution is employed. The minerals depressant composition can comprise the polyamine substituted dithiocarbamate.

It is therefore an object of the present invention to provide a polyamine substituted dithiocarbamate composition.

It is also an object of the present invention to provide a process for producing the polyamine substituted dithiocarbamate and other compositions useful as minerals depressants in an ore flotation process.

Another object of the present invention is to provide an improved ore flotation process using the polyamine substituted dithiocarbamate and other compositions produced by reacting carbon disulfide with a polyamine in an aqueous alkali metal hydroxide or alkaline earth metal hydroxide solution as minerals depressants.

Other objects, features and advantages of the invention will be readily apparent to those skilled in the art upon a reading of the description of preferred embodiments which follows.

DESCRIPTION OF THE PREFERRED EMBODIMENTS

In accordance with the present invention, a new and useful composition is provided. It has been found that the composition is useful as a minerals depressant in an ore flotation process. The composition is a polyamine substituted dithiocarbamate represented by the following formula:

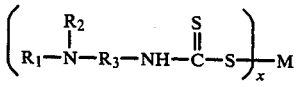

wherein $R_1$ and $R_2$ and of the amine substituent are each selected from the group consisting of an aminoethyl group, an aminohydrocarbyl group and a polyaminohydrocarbyl group $R_3$ of the amine substituent is selected from the group consisting of a hydrocarbyl group, an aminodihydrocarbyl group and a polyaminopolyhydrocarbyl group, is selected from the group consisting of an alkali metal and an alkaline earth metal and x is 1 or 2.

M is preferably sodium or potassium. If $R_1$ or $R_2$ is an aminohydrocarbyl group, or if $R_3$ is a hydrocarbyl group, the group preferably contains from about 3 to about 10 carbon atoms. If $R_1$ or $R_2$ is a polyaminohydrocarbyl group, the group preferably contains from about 2 to about 4 nitrogen atoms and from about 3 to about 10 carbon atoms. If $R_3$ is an aminodihydrocarbyl group or a polyaminopolyhydrocarbyl group, the group preferably contains from about 1 to about 3 nitrogen atoms and from about 3 to about 10 carbon atoms.

In the most preferred form of the composition as represented by the above formula and $R_1$, $R_2$ are each aminoethyl groups $R_3$ is an ethyl group and M is sodium, i.e., sodium tris(2-aminoethyl)amine monodithiocarbamate.

The minerals depressant compositions of this invention can be produced by reacting carbon disulfide with a polyamine in an aqueous alkali metal hydroxide solution or an aqueous alkaline earth metal hydroxide solution. For example, the polyamine substituted dithiocarbamate of the present invention can be produced as follows:

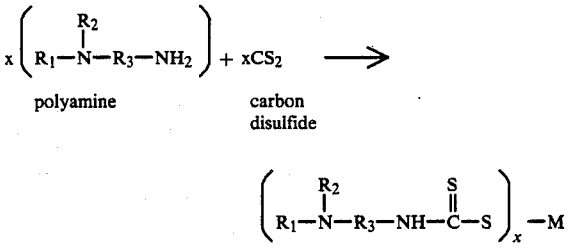

wherein $R_1$ and $R_2$ are each selected from an aminoethyl group, an aminohydrocarbyl group and a polyaminohydrocarbyl group, $R_3$ is selected from a hydrocarbyl group, an aminodihydrocarbyl group and a polyaminpolyhydrocarbyl group, M is an alkali metal or an alkaline earth metal and x is 1 or 2.

The resulting aqueous solution containing the depressant composition is the preferred form of use of the depressant composition. Generally, the aqueous solution contains in the range of from about 20 to about 50 parts by weight of the depressant composition per 100 parts by weight of aqueous solution.

If $R_1$ or $R_2$ is an aminohydrocarbyl group, or if $R_3$ is a hydrocarbyl group, the group preferably contains from about 3 to about 10 carbon atoms. If $R_1$ or $R_2$ is a polyaminohydrocarbyl group, the group preferably contains from about 2 to about 4 nitrogen atoms and from about 3 to about 10 carbon atoms. If $R_3$ is an aminodihydrocarbyl group or a polyaminopolyhydrocarbyl group, the group preferably contains from about 1 to about 3 nitrogen atoms and from about 3 to about 10 carbon atoms.

The most preferred depressant composition of the invention is formed using a polyamine wherein each of $R_1$ and $R_2$ is an aminoethyl group and $R_3$ is an ethyl group. An aqueous alkali metal hydroxide solution is preferably used. The alkali metal hydroxide used can be sodium hydroxide or potassium hydroxide, most preferably sodium hydroxide.

In another aspect of the present invention, compositions produced by reacting carbon disulfide with a polyamine in an aqueous alkali metal hydroxide or alkaline earth metal hydroxide solution, including the above-described polyamine substituted dithiocarbamate, are employed as depressants for the recovery of mineral values from an ore or minerals concentrate containing such values. The depressant compositions of the present invention have special applicability in a froth flotation process wherein molybdenum mineral values are recovered, i.e., the molybdenum is recovered in the froth from an aqueous slurry containing molybdenum ore or a concentrate from the ore. Examples of suitable molybdenum-bearing ores which can be usefully processed in accordance with this invention are molybdenite, wulfenite, powellite and ferrimolybdite. Such ores generally contain copper, lead and iron in addition to molybdenum.

In carrying out the flotation process, the slurry generally contains from about 5 to about 75 weight percent solids of one or more of the above-described molybdenum ores or concentrates formed from the ores. Usually the slurry contains in the range of from about 3 to about 70 weight percent solids, the depressants of this invention and one or more mineral collectors, frothing agents and stabilizers. Examples of mineral collectors useful for recovering molybdenum are fuel oils and mineral oils. Frothing agents which are commonly used in the slurry include polypropylene and polyethylene glycols and the corresponding methyl or ethyl ethers. In addition, isophorone and/or methylisobutyl carbinol can be used. Examples of useful stabilizers are pH conditions such as calcium oxide and polyphosphates.

The amount of the minerals depressant composition utilized, not including water, is generally in the range of from about 0.1 to about 10 pounds of minerals depressant composition per ton of ore or solids in the slurry. Preferably, the quantity of the depressant composition is in the range of from about 0.2 to about 5.0 pounds of depressant per ton of ore, and most preferably in the range of from about 0.5 to about 2 pounds depressant per ton of ore.

A variety of froth flotation apparatus can be used for carrying out this invention. The most commonly used commercial flotation machines are the Agitar (Galigher Company), Denver D-12 (Denver Equipment Company), and the Fagergren (Western Machinery Company).

The following examples further illustrate the invention.

EXAMPLE 1

This example describes an ore flotation process test wherein no mineral depressant was used. A charge of 1000 grams of an ore containing copper, lead, iron and molybdenum (Pinto Valley ore), 560 milliliters of tap water, 0.6 grams of lime, 2 drops (0.018 pounds per ton) of an aromatic oil (Orfom MCO), and 1.1 milliliters (0.011 pounds per ton) of a collector (Aerofloat 238) was placed in a ball mill and the mixture was ground for 10 minutes.

The resulting slurry was transferred to a 2.5 liter capacity Denver D-12 flotation cell. An amount of lime sufficient to adjust the pH of the slurry to 8.5 was added to the cell. Also added to the cell were 1.1 milliliters of sodium isobutyl xanthate, a collector, and 3 drops (0.025 pounds per ton) of a frother (Dowfroth 250). After conditioning the slurry for 1 minute, the slurry was floated for 4 minutes.

Next, the concentrate was transferred to a 1.6 liter capacity Denver D-12 flotation cell. An amount of lime sufficient to adjust the pH of the slurry to 8.5 was added to the cell, and the slurry was conditioned for 2.5 minutes. One drop (0.018 pounds per ton) of an aromatic oil (Orfom MCO) was added to the cell, and the slurry was conditioned for 0.5 minutes and floated for 4 minutes. The final concentrate was then filtered, dried and analyzed.

The procedure was repeated and an average weight percent recovery was calculated from the two runs. The average weight percent recoveries in this example were:

molybdenum: 90%;
copper: 93.5%;
iron: 98.4%; and
lead: 56%.

Thus, in this test where no minerals depressant was used, the ratio of the average weight percent recoveries for molybdenum and iron (90.0 divided by 89.4) was 1.01.

EXAMPLE 2

This example describes the preparation of the minerals depressant composition of this invention.

Sodium hydroxide was dissolved in tap water in a glass, 4-necked, round-bottomed flask fitted with an addition funnel, reflux condenser, and mechanical stirrer. A polyamine [tris(2-aminoethyl)amine] was dissolved in the sodium hydroxide solution. The resulting solution was cooled to about 10° C. with an ice water bath at which time carbon disulfide was added dropwise. As soon as the carbon disulfide addition began, the solution turned yellow/orange, indicating the formation of substituted dithiocarbamate. The reaction flask was maintained at about 10° C. to about 20° C. to prevent the loss of carbon disulfide by evaporation.

The addition of carbon disulfide was completed in about an hour. The reaction mixture was stirred for another hour or until a homogeneous yellow/orange solution indicated that the carbon disulfide has reacted completely. The solution was then allowed to warm to room temperature.

The resulting aqueous solution of tris(2-aminoethyl)amine dithiocarbamate (also called sodium N,N-bis(2-aminoethyl)-2-aminoethyldithiocarbamate) contained a concentation of the minerals depressant in an amount of about 40 parts by weight per 100 parts by weight of aqueous solution.

EXAMPLE 3

This example describes a mineral ore flotation process test similar to that described in Example 1 except for the addition of the minerals depressant composition produced as described in Example 2.

A charge of 1000 grams of the same ore as was utilized in Example 1 (Pinto Valley ore), 560 milliliters of tap water, 0.6 grams of lime, 2 drops (0.018 pounds per ton) of an aromatic oil (Orfom MCO) and 1.1 milliliters (0.011 pounds per ton) of a collector (Aerofloat 238) was placed in a ball mill and the mixture ground for 10 minutes. The slurry was transferred to a 1.6 liter capacity Denver D-12 flotation cell.

An amount of lime sufficient to adjust the pH of the slurry to 8.5 and 1 drop (0.025 pounds per ton) of a frother (Dowfroth 250) were added to the cell. Also added to the cell were 2 milliliters (0.8 pounds per ton) of an aqueous solution containing 1 percent by weight of the aqueous solution of minerals depressant composition prepared as described in Example 2.

The slurry was conditioned for 2.5 minutes and 1 drop (0.018 pounds per ton) of an aromatic oil (Orfom MCO) were added to the cell. The slurry was then conditioned for 30 seconds and floated for 4 minutes. After the slurry was floated, the concentrate was filtered, dried and analyzed.

The procedure was repeated and an average weight percent recovery was calculated from the two runs. The average weight percent recoveries in this example were:

molybdenum: 55.6%;
copper: 17.1%;
iron: 12.4%; and
lead: 20.4%.

Thus, in this test with the minerals depressant of the invention being used, the ratio of the average weight percent recoveries from molybdenum and iron (55.6 divided by 12.4) was 4.48.

From a comparison of the results obtained in Examples 1 and 3, it is evident that the minerals depressant composition of the present invention provided effective depressing of minerals recovery relative to molybdenum recovery.

What is claimed is:

1. In a process for the recovery of first metal mineral values from an ore or concentrate containing said first metal mineral values and second metal minerals wherein certain said first mineral values are recovered in a froth from an aqueous slurry containing the ore or concentrate, and wherein a minerals depressant is employed in the aqueous slurry to reduce the amount of the second metal minerals in the froth, the improvement comprising employing as said minerals depressant in an amount effective to depress said second metal minerals a composition represented by the formula:

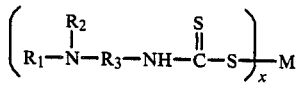

wherein $R_1$ and $R_2$ are each selected from the group consisting of an aminoethyl group, an aminohydrocarbyl group and a polyaminohydrocarbyl group, $R_3$ is selected from the group consisting of a hydrocarbyl group, an aminodihydrocarbyl group and a polyaminopolyhydrocarbyl group, M is selected from the group consisting of an alkali metal and an alkaline earth metal, and x is 1 or 2.

2. The process of claim 1 wherein each of $R_1$ and $R_2$ is an amino ethyl group and $R_3$ is an ethyl group.

3. The process of claim 2 wherein M is selected from the group consisting of sodium and potassium.

4. The process of claim 2 wherein M is sodium.

5. The process of claim 1 wherein said minerals depressant is employed in said aqueous slurry by adding an aqueous solution containing in the range of from about 20 to about 50 parts by weight of said minerals depressant per 100 parts aqueous solution to said aqueous slurry.

6. The process of claim 5 wherein said minerals depressant is present in the slurry in an amount in the range of from about 0.1 to about 10 pounds of depressant per ton of solids in the slurry.

7. The process of claim 1 wherein each of $R_1$ and $R_2$ is an aminoethyl group, $R_3$ is an ethyl group, M is sodium and said minerals depressant is present in said slurry in an amount in the range of from about 0.5 to about 2 pounds depressant per ton of solids in the slurry.

8. In a process for the recovery of molybdenum values from an ore or concentrate, wherein the values are recovered in a froth from an aqueous slurry of solids of the ore or concentrate, and wherein a minerals depressant is employed in the aqueous slurry to reduce the amount of at least one copper, iron, or lead minerals in the froth, the improvement comprising employing as said minerals depressant in the slurry, in an amount effective to depress at least one of copper, iron or lead minerals from the froth, a composition represented by the formula:

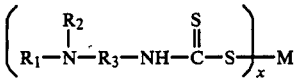

wherein $R_1$ and $R_2$ are each selected from the group consisting of an aminoethyl group, an aminohydrocarbyl group and a polyaminohydrocarbyl group, $R_3$ is selected from the group consisting of a hydrocarbyl group, an aminohydrocarbyl group and a polyaminopolyhydrocarbyl group, M is selected from the group consisting of an alkali metal and an alkaline earth metal, and x is 1 or 2.

9. The process of claim 8 wherein each of said $R_1$ and $R_2$ is an aminoethyl group and $R_3$ is an ethyl group.

10. The process of claim 9 wherein M is selected from the group consisting of sodium and potassium.

11. The process of claim 9 wherein M is sodium.

12. The process of claim 8 wherein said minerals depressant is employed in said slurry by adding an aqueous solution containing in the range of from about 20 to about 50 parts by weight of said minerals depressant per 100 parts aqueous solution to said aqueous slurry.

13. The process of claim 12 wherein said mineral depressant is present in said slurry in an amount in the range of from about 0.1 to about 10 pounds of depressant per ton of solids in the slurry.

14. The process of claim 12 wherein each of $R_1$ and $R_2$ is an aminoethyl group, $R_3$ is an ethyl group, M is sodium and said minerals depressant is present in said slurry in an amount in the range of from about 0.5 to about 2 pounds of depressant per ton of solids in the slurry.

15. In a process for the recovery of first metal mineral values from an ore or concentrate containing said first metal mineral values and second metal minerals wherein said first metal minerals values are recovered in a froth from an aqueous slurry containing the ore or concentrate, and wherein a minerals depressant is employed in the aqueous slurry in an amount effective to reduce the amount of the second metal minerals in the froth, the improvement comprising employing as said minerals depressant a composition produced by reacting carbon disulfide with a polyamine in an aqueous solution comprising a compound selected from the group consisting of an alkali metal hydroxide and an alkaline earth metal hydroxide, said polyamine being represented by the formula

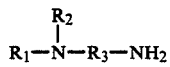

wherein $R_1$ and $R_2$ are each selected from the group consisting of an aminoethyl group, an aminohydrocarbyl group and a polyaminohydrocarbyl group, and $R_3$ is selected from the group consisting of a hydrocarbyl group, an aminodihydrocarbyl group and a polyaminopolyhydrocarbyl group.

16. The process of claim 15 wherein each of said $R_1$ and $R_2$ is an aminoethyl group and $R_3$ is an ethyl group.

17. The process of claim 16 wherein said aqueous solution comprises an alkali metal hydroxide selected from the group consisting of sodium hydroxide and potassium hydroxide.

18. The process of claim 17 wherein said alkali metal hydroxide is sodium hydroxide.

19. The process of claim 17 wherein said composition employed as said minerals depressant is present in said slurry in an amount in the range of from about 0.1 to about 10 pounds depressant per ton of solids in the slurry.

* * * * *

UNITED STATES PATENT AND TRADEMARK OFFICE

CERTIFICATE OF CORRECTION

PATENT NO. : 4,806,234

DATED : February 21, 1989

INVENTOR(S) : Clarence R. Bresson and Harold W. Mark

It is certified that error appears in the above-identified patent and that said Letters Patent is hereby corrected as shown below:

Column 1, in the Summary of the Invention, delete the formula shown and substitute the following formula therefor:

$$-- \left( R_1 - \overset{R_2}{\overset{|}{N}} - R_3 - NH - \overset{S}{\overset{\|}{C}} - S \right)_x - M \quad -- \quad ;$$

Column 1, line 58, insert a comma between "group" and "$R_3$";

Column 1, line 61, insert --M-- between the comma and "is";

Column 2, in the Summary of the Invention, delete the formula shown and substitute the following formula therefor:

$$-- \quad R_1 - \overset{R_2}{\overset{|}{N}} - R_3 - NH_2 \quad -- \quad ;$$

(5) Column 2, in the Description of the Preferred Embodiments, delete the formula shown and substitute the following formula therefor:

$$-- \left( R_1 - \overset{R_2}{\overset{|}{N}} - R_3 - NH - \overset{S}{\overset{\|}{C}} - S \right)_x - M \quad -- \quad ;$$

Column 2, line 62, insert a comma between "group" and "$R_3$";

Column 2, line 65, insert --M-- between the comma and "is";

Column 3, line 10, delete the comma between "$R_1$" and "$R_2$" and substitute --and-- therefor;

Column 3, line 11, insert a comma between "groups" and "$R_3$";

Column 6, line 28, delete the word "certain";

UNITED STATES PATENT AND TRADEMARK OFFICE

CERTIFICATE OF CORRECTION

PATENT NO. : 4,806,234

DATED : February 21, 1989

INVENTOR(S) : Clarence R. Bresson and Harold W. Mark

It is certified that error appears in the above-identified patent and that said Letters Patent is hereby corrected as shown below:

Column 6, claim 1, delete the formula shown and substitute the following formula therefor:

-- $$\left(R_1 - \overset{\overset{R_2}{|}}{N} - R_3 - NH - \overset{\overset{S}{\|}}{C} - S\right)_x - M$$ -- ;

Column 7, line 8, insert the word --of-- between "one" and "copper";

Column 7, claim 8, delete the formula shown and substitute the following formula therefor:

-- $$\left(R_1 - \overset{\overset{R_2}{|}}{N} - R_3 - NH - \overset{\overset{S}{\|}}{C} - S\right)_x - M$$ -- ; and Column 8, line 7, delete the word "minerals" and substitute the word --mineral-- therefor.

Signed and Sealed this

Thirty-first Day of October, 1989

*Attest:*

*Attesting Officer*

DONALD J. QUIGG

*Commissioner of Patents and Trademarks*